United States Patent [19]

Thompson et al.

[11] 4,010,337

[45] Mar. 1, 1977

[54] TOGGLE DEVICE

[75] Inventors: Paige W. Thompson, Morrison; James P. Frank, Rock Falls, both of Ill.

[73] Assignee: General Electric Company, Fort Wayne, Ind.

[22] Filed: June 9, 1975

[21] Appl. No.: 585,149

Related U.S. Application Data

[63] Continuation of Ser. No. 442,838, Feb. 15, 1974, abandoned.

[52] U.S. Cl. ..... 200/67 D; 337/319; 200/83 P

[51] Int. Cl.[2] ..... H01H 13/36

[58] Field of Search ..... 200/67 R, 67 D, 67 A, 200/83 P; 74/100, 100 P; 337/101, 311, 317, 318, 319; 29/622

[56] References Cited

UNITED STATES PATENTS

| | | | |
|---|---|---|---|
| 2,229,612 | 1/1941 | Pearce | 337/319 |
| 3,032,626 | 5/1962 | Payne | 200/83 P |
| 3,629,769 | 12/1971 | Slonneger | 337/318 |
| 3,648,214 | 3/1972 | Slonneger | 337/311 |
| 3,654,578 | 4/1972 | Thompson | 337/317 |
| 3,701,962 | 10/1972 | Ball et al. | 337/101 |

FOREIGN PATENTS OR APPLICATIONS

| | | | |
|---|---|---|---|
| 427,015 | 1/1934 | United Kingdom | 337/318 |

*Primary Examiner*—David Smith, Jr.
*Attorney, Agent, or Firm*—Joseph E. Papin

[57] ABSTRACT

A toggle device has a fixed support with a pair of fixed abutments thereon, and a toggle arm pivotally mounted in the device is adapted for pivotal movement in response to a variable motive force between the abutments into motion limiting engagement therewith, respectively. A toggle spring engaged with the toggle arm is adapted to be compressed for transmitting a force applied thereto onto the toggle arm generally in opposition to the motive force. Means is mounted to the support and engaged with the toggle spring so as to compress it for establishing the applied force. Means is mounted to the support and engaged with the establishing means for positioning it and the toggle spring so as to angularly direct the applied force through the toggle spring onto the toggle arm.

An electric switch is also disclosed.

16 Claims, 7 Drawing Figures

TOGGLE DEVICE

CROSS-REFERENCE TO RELATED PATENT APPLICATIONS

This patent application is a continuation of patent application Ser. No. 442,838 filed Feb. 15, 1974, now abandoned the contents of which are specifically incorporated by reference.

This patent application is related to copending applications Ser. Nos. 433,593 and 433,594 filed Jan. 15, 1974 which are specifically incorporated herein by reference.

BACKGROUND OF THE INVENTION

This invention relates generally to means for effecting actuation of electrical switches and in particular to a toggle device, an electrical switch incorporating a toggle device, and a method of loading a toggle device.

In the past, various types of toggle devices were utilized in many different types of electrical switches for relatively moving a pair of contacts with snap-action between making and breaking positions in a circuit. Generally, each of the past toggle devices was provided with an operator or arm pivotally movable for actuating the contacts between make and break positions, and one of a pair of opposite ends of a toggle spring was pivotally engaged with the arm.

In order to obtain effective toggling operation in one such past toggling device, the toggle spring thereof was loaded or adjusted against the toggle arm, normally in a direction generally parallel thereto, and such loading effected only a selected differential between the tripping force and the resetting force of the toggling device. Of course, one of the disadvantageous or undesirable features of this past toggling device was that although the differential between the tripping and resetting forces was adjustably preselected, the magnitudes of the tripping and resetting forces could not be adjusted to preselected values.

In order to predeterminately select the magnitude of the tripping force desired, an additional bias or range spring was utilized to oppose and assist toggling movement of the toggle arm. However, one of the disadvantageous or undesirable features of the past toggle devices employing arrange spring was that the range spring added extra positive gradients to the toggle device thereby to necessitate further increasing the effect of the toggle, i.e. the negative gradient action, to obtain the desired differential between the tripping and resetting forces. This type of past toggle device, as utilized in a thermostat, is illustrated in U.S. Pat. Nos. 3,629,769, 3,648,214 and 3,654,378.

Other past toggle devices were provided with an additional adjustment which adjustably varied stop abutments for controlling the reciprocal movement or stroke of the toggle arm, but one of the disadvantageous or undesirable features of this type of past toggle device was that the distance through which the driving force moved was not constant and/or the direction of the driving force was altered during adjustment.

SUMMARY OF THE INVENTION

Among the several objects of the present inventions may be noted the provision of a toggle device and an electrical switch which overcome the disadvantage or undesirable features of the past toggle devices, as discussed hereinbefore, as well as others; the provision of such toggle device and electrical switch in which a loading force is adjustably directed for attaining the desired magnitudes for both the tripping and resetting forces thereof; the provision of such toggle device and electrical switch in which actuation or toggling through does not affect the stability of the tripping and resetting forces; the provision of such toggle device and electrical switch in which separate adjustments for predetermining the tripping force and the resetting force are transmitted through a single biasing means; the provision of such toggle device and electrical switch in which the components for adjusting the tripping and resetting forces are compacted so as to meet rather limited space factor requirements; the provision of such toggle device electrical switch in which a means for loading a toggle spring extends adjacent and generally along both the toggle spring an a pivotally movable member loaded thereby; and the provision of such and toggle device, electrical switch having components which are simplistic in design, economically manufactured, and easily assembled. Other objects and advantageous features of the present invention will be in part apparent and in part pointed out hereinafter.

In general, a toggle device in one form of the invention has means pivotally movable between a pair of opposite positions, and resilient means disposed generally in end-to-end relation with the first named means for imparting snap-action thereto. The first named means is pivotally movable in response to an applied force of a predetermined value against the resilient means toward one of the opposite positions, and the resilient means assists return pivotal movement of the first named means toward the other of the opposite positions in response to another predetermined value of the applied force. Means extends generally along both the resilient means and the first named means for applying another force through the resilient means to the first named means determinative of the first named and other predetermined values of the applied force.

Further and in general, an electrical switch in one form of the invention has a pair of contacts for relative movement between make and break positions, and means is generally reciprocally movable for actuating at least one of the contacts between its make and break positions. Means applies a varying force on the actuating means for effecting its reciprocal movements under preselected conditions, and resilient means is engaged generally in end-to-end relation with the actuating means for respectively opposing and assisting the reciprocal movements of the actuating means. Means is engaged with the resilient means and extends generally along both the resilient means and the actuating means for predetermining the magnitudes of the applied force effecting the reciprocal movements of the actuating means when opposed and assisted by the resilient means, respectively.

DESCRIPTION OF THE PREFERRED EMBODIMENTS

Figure 1:
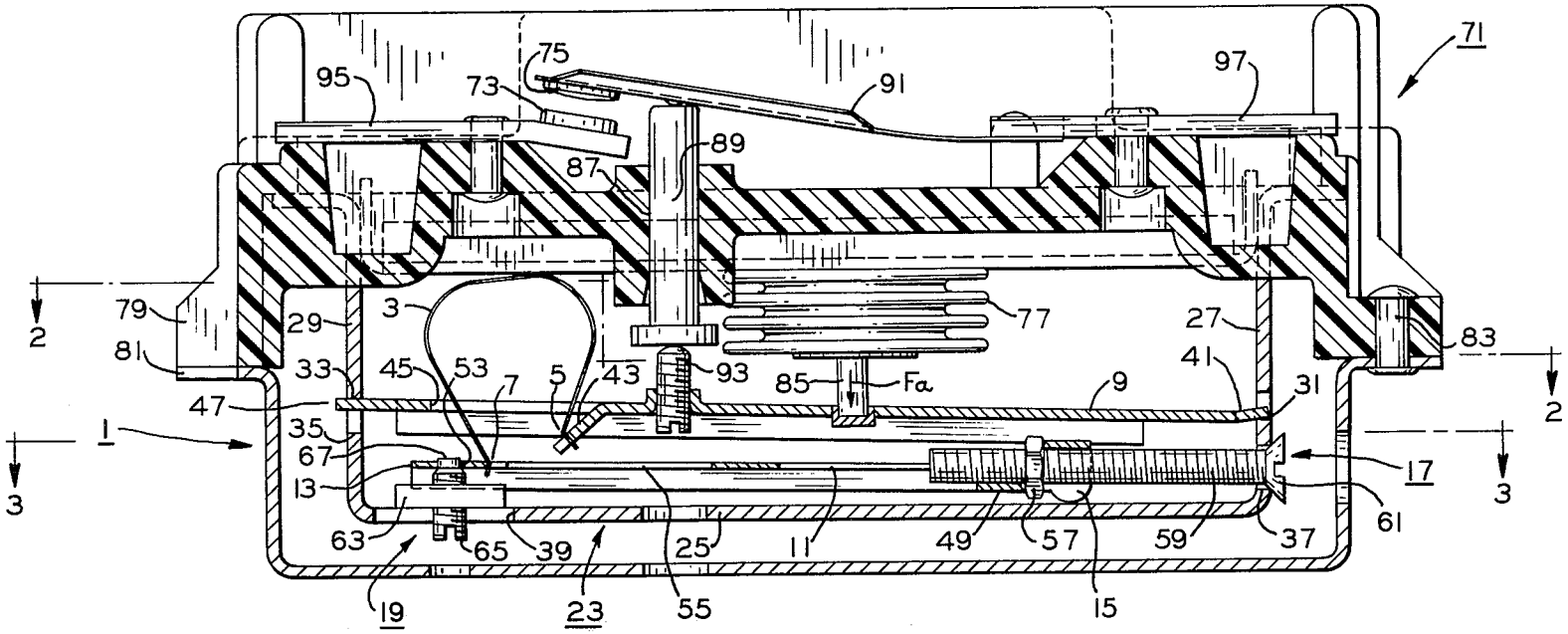
FIG. 1 is a sectional of an apparatus embodying the invention.

Referring now to the drawings in general, there is illustrated a method for loading a toggle device 1 (FIGS. 1–3) having resilient means, such as a toggle spring 3, with one of its opposite ends 5, 7 disposed generally in end-to-end relation with a or pivotally movable actuated member, such as a toggle arm 9. In this method, adjusting means, such as a biasing link or force transmitting assembly or member 11, is disposed generally along both arm 9 and toggle spring 3 for biasing the other of the opposite ends 5 thereof or for estabilishing an applied or loading force F*l* thereon. Biasing member or force estabilishing means 11 is urged against toggle spring 3 for establishing the loading force F*l*, and the biasing member is tilted for directing the loading force angularly onto arm 9, the angularly directed loading force having a vertical component F*y* respectively opposing and assisting the reciprocal movement of the arm (FIGS. 4-7).

Figure 2:
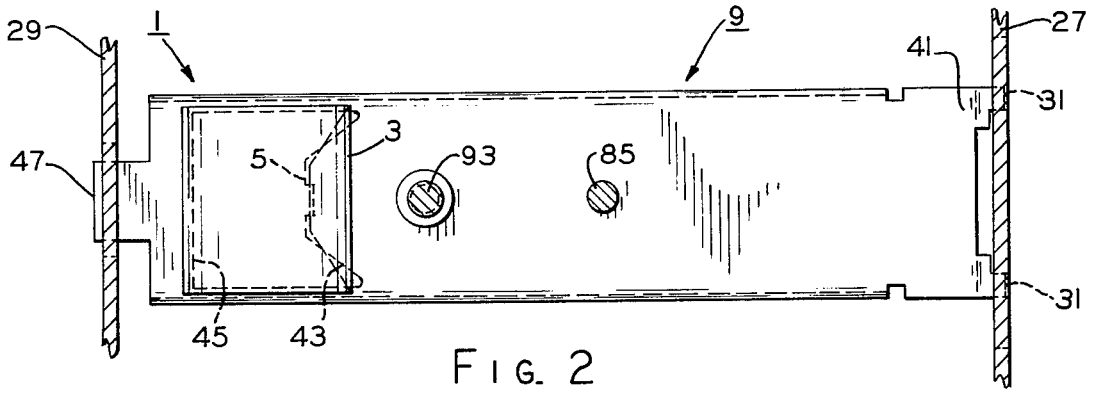
FIG. 2 is a sectional view substantially along 2—2 of FIG. 1.
Figure 3:
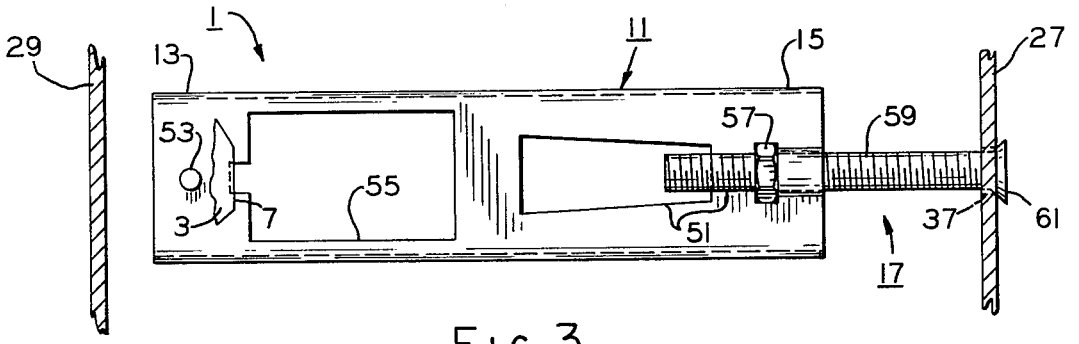
FIG. 3 is a sectional view substantially along 3—3 of FIG. 1.

More particularly with reference to FIGS. 1-3, one of a pair of opposite end portions 13, 15 of biasing member 11 is connected with toggle spring end 7, and the other opposite end portion 15 is connected with means, such as an adjusting means device indicated generally at 17, for adjustably selecting the magnitude of loading force F*l* which drives or pulls the biasing member generally in a generally horizontal direction or generally parallel to the biasing member so as to move toggle spring end 7 generally closer to toggle spring end 5 for compressing toggle spring 3 against arm 9. In this manner, the compression of toggle spring 3 determines the magnitude of loading force F*l*. Alternatively, means, such as an adjusting means of device indicated generally at 19, may be adjustably operated either prior or subsequent to the adjusting of adjusting device 17. Adjusting device 19 is operable for exerting a force generally in the vertical direction or generally normal to biasing number 11 adjacent end portion 13 thereof, and this force adjustably drives or moves the biasing member to tilt or pivot it for adjusting the angularity or altitude of toggle spring end 7 relative to toggle spring end 5 thereby to direct the loading force F*l* angularly through toggle spring 3 onto toggle arm 9. In this manner, the angularity or difference in altitude of toggle spring ends 5, 7 determines an angle 21, as shown graphically in FIGS. 4–7, at which loading force F*l* is directed against arm 9, and such angularity also provides toggle spring 3 with a negative gradient for imparting snap-action to arm 9 upon the reciprocal movement thereof. A vertical component F*y* of loading force F*l* urges arm 9 toward its position shown in FIG. 4 and opposes movement thereof to its position shown in FIG. 5, and the magnitude of a motive force F*a* required to effect or trip such movement of the arm is a function of angle 21 and loading force F*l*. Therefore, angle 21 and loading force F*l* are determinative of or predetermines the tripping value of motive force F*a*. Further, when arm 9 is in its position shown in FIG. 5, angle 21 is reduced proportionally with respect to the pivotal movement of the arm from its original position which, along with the negative gradient effect of toggle spring 3, effects a predetermined reduction in the magnitude of vertical component F*y* of loading force F*l*. Therefore, angle 21 and loading force F*l* are also determinative of or predetermines the value of motive force F*a* at which arm 3 is reset or returned to its original position in FIG. 4. and it follows that the reset value of applied force F*a* at which arm 9 is returned to its original position of predeterminately less than the trip value of the applied force required for moving the arm from its original position. Further, both the trip and reset values of applied force F*a* may be accurately attained or adjusted to any desired magnitude by varying angle 21 at which loading force F*l* is directed against arm 9 and/or varying the magnitude of the loading force.

As generally mentioned hereinabove, toggle device 1 is provided in one form of the invention with means, such as arm 9, pivotally movable between a pair of opposite positions, and resilient means, such as toggle spring 3, is disposed generally in end-to-end relation with the arm for imparting snap-action thereto. Arm 9 is pivotally movable in response to motive force F*a* of the predetermined tripping value against toggle spring 3 toward one of the opposite positions, and the toggle spring assists return pivotal movement of the arm toward the other of the opposite positions in response to the predetermined resetting value of the applied force. Adjusting means, such as biasing member 11, extends generally along both toggle spring 3 and arm 9 for applying loading force F*l* through the toggle spring to the arm determinative of the and predetermined tripping and resetting values of applied force F*a*.

More particularly and with reference to FIGS. 1–3, toggle device 1 is provided with a fixed, generally U-shaped support or frame 23 having a base 25 integrally formed between opposite sides 27, 29. Pivots are provided generally at 31 in side 27 for pivotal engagement with arm 9, and fixedly spaced, opposite abutments 33, 35, which respectively define the opposite or motion limiting positions of the arm, as previously mentioned, are provided in side 29 for engagement with the arm. A pair of openings or slots 37, 39 are also provided in side 27 and base 25 for receiving adjusting devices 17, 19, as discussed hereinafter.

Arm 9 is generally elongate and flat being provided with opposite end portions 41, 43, and one of the arm end portions 41 is pivotally engaged with pivot 31 in support side 27. The other end portion 43 of arm 9 depends through an opening 45 in the arm, and an extension 47, integrally provided on the arm adjacent the other end portion thereof, extends through support side 29 for movement between and motion limiting engagement with abutments 33, 35 therein.

Biasing member 11 is also generally elongate and flat being disposed generally along and adjacent both toggle spring 3 and arm 9, and an elongate stepped slot 51 is provided in end portion 15 of the biasing member. A pair of openings 53, 55 are also provided through biasing member 11 adjacent end portion 13 theeof, and biasing member is drivenly connected with adjusting device 17 through a threaded driven member, such as a nut 57, which is secured in slot 51 against displacement by suitable means (not shown). A driving member such as a manually operable adjustment screw 59, extends through opening 37 in support side 27 into slot 51 of biasing member 11 in driving threaded engagement with nut 57, and a generally frusto-conically shaped head 61 of the adjustment screw is biased into limited pivotal engagement with a portion of the support side extending about the opening therein. Of course, this pivotal engagment of adjustment screw head 61 about with support side 27 about opening 27 therein provides for limited adjusting or pivotal movement of biasing member 11.

Adjusting device or positioning 19 is provided with a slide 63 which is slidably received in opening or slot 39 of support base 25, and a manually operable screw 65 is threadedly received in the slide having an upper end 67 extending into opening 53 provided in biasing member 11 adjacent end portion 13 thereof. In this manner, mounting means, such as slide 63, is slidable or adjustably movable in a direction generally toward and away from support sides 27, 29, and means for adjustably selecting the angle at which the applied force is directed onto the toggle spring, such as its adjusting screw 65, is adjustably movable in a vertical direction generally normal to support base 25 for driving biasing member 11 generally vertically to tilt or pivot it about end portion 15 of biasing member 11. To complete the description of toggle device 1, toggle spring 3 is generally U-shaped extending through opening 45 in arm 9 and opening 55 in biasing member 11 so that opposite ends 5, 7 of the toggle spring are pivotally received in compressive engagement with end portion 43 of the arm and end portion 13 of the biasing member.

In the operation of toggle device 1, it is assumed that adjusting device 17 is adjustably actuated prior to adjusting device 19, but as previously mentioned, adjusting device 19 may alternatively be adjustably actuated prior to adjusting device 17 if desired. Adjusting screw 59 of adjusting device 17 is manually driven by a suitable tool, such as a screw driver (not shown), and the threaded engagement of nut 59 with the adjusting screw exerts a generally horizontal or pulling force on biasing member 11 pulling it rightwardly (as seen in FIG. 1) against toggle spring 3. This adjusting or pulling movement of biasing member 11 is effective to pull end 7 of toggle spring 3 toward or closer to end 5 thereof, and in this manner, the toggle spring is compressed to establish the desired magnitude of loading force Fl. Slide 63 of adjusting device 19 is also pulled or moved rightwardly in slot 39 of support base 25 conjointly with biasing member 11 in response to the pulling force exerted therein by the adjusting actuation of adjusting device 17.

To effect adjusting actuating of adjusting device 19, adjusting screw 65 is also manually driven by the aforementioned tool in the vertical direction (as seen in FIG. 1) to apply a generally vertical force on biasing member 11 tilting or pivotally moving it about the pivotal engagement of adjusting screw head 61 with support side 27 about opening 37 therein. This generally vertical or tilting movement of biasing member 11 in response to the adjusting actuation of adjusting device 19 moves toggle spring end 7 relative to toggle spring end 5 to establish a desired angularity or difference in altitude therebetween, as illustrated by angle 21 in FIGS. 4–7. It may be noted that adjusting device 17 primarily establishes the magnitude of loading force F1 while adjusting device 19 primarily controls the angularity at which the loading force is applied through toggle spring 3 to arm 9.

Figure 4:
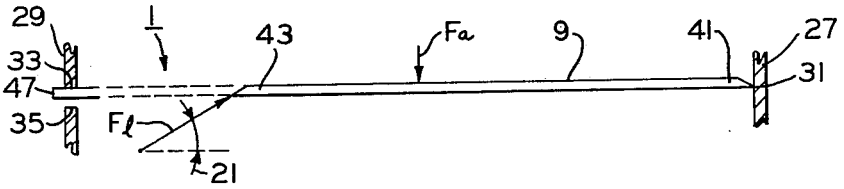
FIGS. 4–7 is a graphic representation of various forces acting on arm 9.
Figure 5:
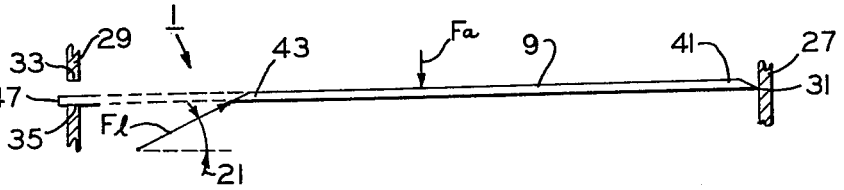
Figure 6:
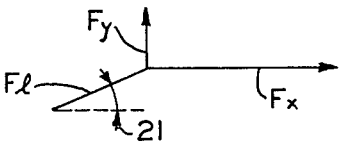
Figure 7:
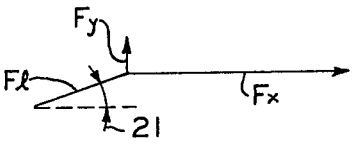

As illustrated graphically in FIGS. 4 and 6, when toggle spring 3 applies loading force F*l* through angle 21 onto arm 9, the vertical component Fy of the loading force pivotally urges the arm in a clockwise direction about the pivotal engagement of its end portion 41 with pivot surfaces 31 on support side 27 toward the arm's original position engaging extension 47 or arm end portion 43 with upper abutment 33 on support side 29. A horizontal component F*x* of loading force Fl urges arm end portion 41 into engagement with pivots 31 on support side 27. As previously noted, the tripping value of applied force F*a* is a function of angle 21 and the magnitude of loading force F*l;* therefore, when motive force F*a* is exerted by suitable means, as discussed hereinafter, on arm 3 to effect toggling actuation thereof, vertical component F*y* of loading force F*l* opposes movement of the arm until the magnitude if the motive force in this particular levering arrangement overcomes the loading force vertical component. In this manner, the angularly directed loading force F*l* predetermines the tripping value of motive force F*a*. When applied force F*a* is increased to its tripping value, vertical component F*y* of loading force F*l* is overcome, and arm 9 is pivotally moved in a counterclockwise direction about its pivoted end portion 41 toward the other or displaced position, as shown in FIG. 5, engaging arm extension 47 with lower abutment 35 in support side 29. As previously mentioned and as well known in the art, the negative gradient action of toggle spring 3 imparts snap-action to the pivotal movement of arm 9. When arm 9 is in its displaced position, angle 21 is reduced, as illustrated graphically in FIG. 7. Since the reset value of motive force F*a* is a function of angle 21 and the magnitude of loading force F*l*, as previously mentioned, the reduction of the angle of toggle spring 3, results in a reduction in the magnitude of vertical component F*y*. Therefore, the resetting value of motive force F*a* is predeterminately less than the tripping value thereof and the differential between the tripping and reset values at which movement of arm 9 is initiated is determined by the magnitude of the loading force F*l*, as previously noted. When the magnitude of motive force F*a* is subsequently reduced to the resetting value thereof, the reduced vertical component F*y* acts on lever 9 to pivot it in a clockwise direction about its pivoted end 41 thereby to return the arm to its original position re-engaging arm extension 47 with upper abutment 33. The increasing magnitude of vertical component F*y* due to the increasing angle 21 of toggle spring 3 also imparts snap-action to this return pivotal movement of arm 9, and to complete the description of the operation or toggling cycle of toggle device 1, the component parts thereof are returned to their original positions, as described hereinbefore, upon the re-engagement of the arm with abutment 33.

Referring now again to FIG. 1, an electrical switch 71 in one form of the invention is generally provided with a pair of contacts 73, 75 for relative movement between make and break positions, and means, such as arm 9, is generally reciprocally movable for actuating at least one of the contacts between its make and break positions. Means, such as a thermal actuator 77 or other driver, for exerting the variable motive force Fa on arm 9 effects its reciprocal movements under certain preselected conditions, and resilient means, such as toggle spring 3, is engaged generally in end-to-end relation with the arm for respectively opposing and assisting the reciprocal movements thereof. Means, such as biasing member 11, is engaged with toggle spring 3 and extends generally along both the toggle spring and arm 9 for establishing the loading force F*l* so as to predetermine the magnitude of the motive force F*a* effecting the reciprocal movements of the arm when opposed and assisted by the toggle spring, respectively.

More particularly, electrical switch 71 is provided with upper and lower housings 79, 81 interconnected by suitable means, such as a plurality of rivets 83, and the upper ends of support sides 27, 29 are suitably connected to the dielectric material forming the upper housing so that toggle device 1 may be encased within the housings. Thermal actuator 77 is connected to frame 23 by suitable means, such as welding, (not shown) and extends therethrough for driving or actuating arm 9 of toggle device 1 upon the occurrence of the certain preselected conditions. Thermal actuator 77 may be of the type disclosed in copending application Ser. No. 433,594 filed Jan. 15, 1974 which is incorporated herein by reference, and for a more detailed description of the thermal actuator and its operation, reference may be had to this copending application. A connecting link 85 is interposed between thermal actuator 77 and arm 9 of toggle device 1 for transmitting to the arm the variable motive force F*a* generated by the thermal actuator. While connecting link 85 is disclosed for transmitting applied force F*a*, it is also contemplated that other force transmitting means may also be utilized, such as that disclosed in copending application Ser. No. 433,593 filed Jan. 15, 1974 which is incorporated herein by reference. A vertical bore 87 is provided in upper housing 79, and a contact operating link 89 is slidably or movably received in the bore in abutment between an electrical conductive movable or spring arm 91 for carrying movable contact 75 and a contact spacing or adjusting screw 93 adjustably or threadedly received in arm 9 of toggle device 1. Adjusting screw 89 may be manually adjusted to vertically move contact operating link 89 to an adjusted position for attaining a desired spacing or break position of movable contact 75 from stationary contact 73. To complete the description of electrical switch 71, stationary contact 73 and spring arm 91 of movable contact 75 are disposed in current transmitting relation with a pair of busses 95, 97 adapted to be connected in an electrical circuit (not shown).

In the operation of electrical switch 71, thermal actuator 77 establishes motive force Fa upon the occurrence of pre-selected conditions, and the motive force is transmitted through connecting link 85 to arm 9 of toggle device 1 effecting operation thereof generally in the same manner as described hereinbefore. When motive force F*a* attains its tripping value, arm 9 is pivoted counterclockwise from its original position in engagement with upper abutment 33 on support side 29 toward engagement with lower abutment 35. Contact operating link 89 follows the pivotal, snap-action movement of arm 9, and the resilient contact carrying arm 91 moves its movable contact 75 with snap-action into making engagement with stationary contact 73 for completing the electrical circuit (not shown) therethrough.

Upon the occurrence of other preselected conditions, the magnitude of motive force F*a* established by thermal actuator 77 is reduced to the resetting value thereof, and toggle spring 3 is effective to pivotally return or reset arm 9 with snap-action from its displaced position engaged with lower abutment 35 toward its original position in engagement with upper abutment 33, as previously discussed in detail. To complete the description of the operation of electrical switch 71, contact operating link 89 is driven by the return pivotal movement of arm 9 to conjointly drive contact arm 91 and movable contact 75 with snap-action to the break position thereof disengaging the movable contact from stationary contact 73 and interrupting the electrical circuit therethrough.

From the foregoing, it is now apparent that a novel toggle device 1, and electrical switch 71 are presented meeting the objects and advantageous features set out hereinbefore, as well as others, and that changes as to the precise arrangements shapes, details and connections of the component parts of the toggle device and electrical switch, may be made by those having ordinary skill in the art without departing from the spirit of the invention or the scope thereof as set out by the claims which follow.

What we claim as new and desire to secure by Letters Patent of the United States is:

1. A toggle device comprising a support, a pair of abutments on the support, a toggle arm mounted on the support and pivotally movable in response to a variable motive force applied thereon between the abutments into motion limiting engagement therewith, respectively, a toggle spring having one of a pair of opposite ends thereof engaged with the toggle arm and adapted to be compressed for transmitting a force applied thereto onto the toggle arm generally in opposition to the motive force so as to urge the toggle arm toward engagement with one of the abutments, adjusting means pivotally mounted on the support and engaged with the other of the opposite ends of the toggle spring so as to compress the one opposite end thereof against the toggle arm for adjustably establishing the magnitude of applied force, and other adjusting means mounted on the support and engaged with the first named adjusting means for pivoting it and the toggle spring so as to adjust the other opposite end thereof with respect to the opposite end and angularly direct the applied force through the toggle spring onto the toggle arm.

2. A toggle device as set forth in claim 1 wherein the first named adjusting means includes means for adjustably selecting the magnitude of the applied force.

3. A toggle device as set forth in claim 1 wherein the first named adjusting means includes an adjustable link having opposite end portions, one of said end portions being engaged with the one opposite end of the toggle spring and the other of the opposite end portions being pivotally mounted to the support.

4. A toggle device as set forth in claim 1 wherein the other adjusting means includes means for adjustably selecting the angle at which the applied force is directed onto the toggle spring.

5. A toggle device as set forth in claim 1 wherein the other adjusting means includes means for movably mounting it to the support.

6. A toggle device as set forth in claim 1 wherein the first named adjusting means includes a pair of opposite end portions, one of the opposite end portions being pivotally mounted to the support, and the other means including means adjustably engaged with the the other of the opposite end portions of the first named adjusting means for pivoting it so as to adjust the angle at which the applied force is directed onto the toggle spring.

7. A toggle device as set forth in claim 1 wherein the other adjusting means includes means for movably mounting it to the support, and means adjustably mounted to the movably mounting means and engaged with the first named adjusting means for pivoting it so as to adjust the angle at which the applied force is directed onto the toggle spring.

8. A toggle device as set forth in claim 1 wherein the first named adjusting means includes means for adjustably selecting the magnitude of the applied force.

9. A toggle device as set forth in claim 1 wherein the first named adjusting means includes means for adjustably selecting the magnitude of the applied force which primarily predetermines a differential between the values of the motive force necessary to initiate the movement of the toggle arm into engagement with one of the abutments and its return movement into engagement with the other of the abutments, and the other adjusting means including means for adjustably selecting the angularity of the applied force directed through the toggle spring onto the toggle arm which primarily predetermines the values of the motive force at which the movements of the toggle arm toward its engagement with the one and other abutments are respectively initiated.

10. A toggle device comprising a toggle arm pivotally mounted in the device and adapted for movement between a pair of predetermined opposite positions, a toggle spring having one of a pair of opposite ends engaged with the toggle arm and adapted to be compressed for transmitting an applied force to the toggle arm, the toggle arm being pivotally movable in response to a motive force toward one of the opposite positions against the toggle spring and the applied force thereon and the toggle spring and the applied force thereon assisting the return pivotal movement of the toggle arm toward the other of the opposite positions upon a predetermined reduction in the magnitude of the motive force, adjusting means pivotally mounted in the device and adjustably engaged with the other of the opposite ends of the toggle spring for establishing the applied force on the toggle spring so as to primarily predetermine a differential between the values of the motive force necessary to initiate the respective pivotal movements of the toggle arm toward its opposite positions, and other adjusting means adjustably mounted on the support and engaged with the first named adjusting means for pivoting it so as to adjust the other opposite end of the toggle spring with respect to the one opposite end thereof and angularly direct the applied force through the toggle spring onto the toggle arm to primarily predetermine the values of the motive force at which the pivotal movements of the toggle arm toward its opposite positions are respectively initiated.

11. A toggle device comprising a fixed support, a pair of fixed abutments on the support, a toggle arm pivotally mounted to the support and movable between the abutments for engagement therewith, a toggle spring having one of a pair of opposite ends engaged with the toggle arm and adapted to be compressed for transmitting a directed applied force onto the toggle so as to urge it toward engagement with one of the abutments, means for establishing the directed applied force including a member extending generally adjacent both the toggle spring and the toggle arm and engaged with the other of the opposite ends of the toggle spring, and a first adjusting screw pivotally mounted to the support and threadedly engaged with the member, the first adjusting screw being operable generally to threadedly drive the member against the other opposite end of the toggle spring to compress it against the toggle arm thereby to establish the magnitude of the applied force, and means for directing the applied force generally angularly onto the toggle arm including a second adjusting screw mounted on the support and drivingly engaged with the member, the second adjusting screw being operable generally to drive the member and conjointly pivot the first adjusting screw on the support so that the member displaces the other opposite end of the toggle spring relative to its one opposite end thereby to angularly direct the applied force onto the toggle arm, the toggle arm being pivotally movable in response to a motive force acting thereon in excess of the directed applied force toward engagement with the other of the abutments, and the angularity between the opposite ends of the toggle spring being reduced when the toggle arm is engaged with the other abutment thereby to reduce proportionally the value of the directed applied force necessary for returning the toggle arm toward re-engagement with the one abutment upon a subsequent reduction of the motive force to a value less than the reduced value of the directed applied force.

12. An electrical switch comprising a housing, a pair of contacts mounted to the housing and adapted for relative movement between make and break positions, a pair of abutments in the housing, means pivotally mounted in the housing and movable between the abutments for actuating one of the contacts between its make and break positions, means for exerting a variable motive force on the actuating means, resilient toggle means having one of a pair of opposite ends engaged with the actuating means and adapted to be compressed for transmitting an applied force onto the actuating means generally in opposition to the motive force acting thereon, adjusting means pivotally mounted to the housing and engaged with the other of the opposite ends of the resilient toggle means so as to compress the one opposite end thereof against the actuating means for adjustably establishing the magnitude of the applied force thereon, and other adjusting means movably mounted in the housing and adjustably engaged with the first named adjusting means for pivoting it to adjust the angle between the opposite ends of the resilient toggle means and direct the applied force generally angularly therethrough onto the actuating means in opposition to the motive force.

13. An electrical switch as set forth in claim 12 wherein the first named adjusting means includes means for adjustably selecting the magnitude of the applied force.

14. An electrical switch as set forth in claim 12 wherein the other adjusting means includes means engaged with the first named adjusting means for pivoting it so as to adjustably vary the angle through which the applied force is directed onto the resilient toggle means.

15. An electrical switch as set forth in claim 12, further comprising a pair of abutments within the housing for engagement with the actuating means the actuating means being pivotally movable in response to the motive force against the resilient toggle means and the applied force thereon toward engagement with one of the abutments to effect the movement of the one contact to one of its make and break positions and the resilient toggle means and the applied force acting to return the actuating means towards engagement with the other of the abutments to effect the movement of the one contact to the other of its make and break positions upon a reduction in the magnitude of the motive force to a value less than the applied force.

16. An electrical switch comprising a housing, a stationary contact mounted to the housing, a movable contact mounted to the housing for making and breaking engagement with the stationary contact, a pair of spaced apart abutments in the housing, a toggle arm pivotally mounted in the housing and movable between the abutments for engagement therewith, means adapted to be actuated for exerting a variable motive force on the toggle arm, a link movable in the housing and connected between the toggle arm and the movable contact, a toggle spring having one of a pair of opposite ends engaged with the toggle arm and adapted to be compressed for transmitting a directed applied force onto the toggle arm, the toggle arm being urged in one direction in response to the directed applied force thereon toward engagement with one of the abutments and to urge the movable contact toward its breaking engagement from the stationary contact, means pivotally mounted in the housing and adjustably engaged with the other of the opposite ends of the toggle spring so as to compress it against the toggle arm for selectively establishing the magnitude of the applied force, and means mounted in the housing and adjustably engaged with the establishing means for positioning it pivotally so as to displace the other opposite end of the toggle spring relative to its one opposite end thereby to generally angularly direct the applied force through the toggle spring onto the toggle arm, the toggle arm being pivotally movable in response to the motive force thereon having a value in excess of that of the applied force generally against the toggle spring toward engagement with the other of the abutments and to effect the making engagement of the movable contact with the stationary contact upon the actuation of the exerting means, and the movement of the toggle arm toward engagement with the other abutment being effective to displace the other opposite end of the toggle spring relative to its one opposite end to reduce the angularity therebetween so as to reduce proportionally the value of the applied force necessary for returning the toggle arm toward re-engagement with the one abutment upon a subsequent reduction of the motive force to a value less than the reduced value of the applied force.

* * * * *

UNITED STATES PATENT AND TRADEMARK OFFICE

CERTIFICATE OF CORRECTION

PATENT NO. : 4,010,337

DATED : March 1, 1977

INVENTOR(S) : Paige W. Thompson & James P. Frank

It is certified that error appears in the above-identified patent and that said Letters Patent are hereby corrected as shown below:

Col. 1, line 46, delete "arrange" and insert --a range--;
line 66, delete "disadvantage" and insert --disadvantageous--.

Col. 2, line 19, delete "and" (second occurrence);
line 20, delete "," (comma) and insert --and--;
line 60, after "sectional" insert --view--.

Col. 3, line 8, after "a" insert --reciprocally--;
line 14, delete "estabilishing" and insert --establishing--;
line 35, delete "of" and insert --or--.

Col. 4, line 1, delete "." (period) and insert --,-- (comma);
line 3, delete "of" and insert --is--;
line 57, after "member" insert --,-- (comma).

Col. 5, line 3, after "operable" insert --adjusting--;
line 11, delete "its".

Col. 6, line 7, delete "if" and insert --of--.

Col. 8, line 2, delete "," (comma);
line 7, delete "," (comma).

Col. 9, line 1, delete "1" and insert --7--.

Col. 10, line 52, delete "," (comma);
line 54, after "means" insert --,-- (comma);
line 61, delete "towards" and insert --toward--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*